US005347814A

United States Patent [19]

Kemmer et al.

[11] Patent Number: 5,347,814

[45] Date of Patent: Sep. 20, 1994

[54] STEAM SYSTEM IN A MULTIPLE BOILER PLANT

[75] Inventors: Leif Kemmer, Lotorp; Karl J. Nilsson, Finspong, both of Sweden

[73] Assignee: ABB Carbon AB, Finspong, Sweden

[21] Appl. No.: 995,082

[22] Filed: Dec. 22, 1992

[30] Foreign Application Priority Data

Dec. 23, 1991 [SE] Sweden ..... 9103835

[51] Int. Cl.[5] ..... F01K 13/00

[52] U.S. Cl. ..... 60/676; 60/679

[58] Field of Search ..... 60/676, 653, 677, 716, 60/679

[56] References Cited

U.S. PATENT DOCUMENTS

| | | | |
|---|---|---|---|
| 2,874,543 | 2/1959 | Culver | 60/676 |
| 4,007,595 | 2/1977 | Braytenbah et al. | 60/679 |
| 4,060,990 | 12/1977 | Guido et al. | 60/676 |
| 4,306,417 | 12/1981 | Binstock et al. | 60/676 |
| 4,873,827 | 10/1989 | Hadano et al. | 60/679 |
| 5,181,381 | 1/1993 | Gander | 60/676 |

FOREIGN PATENT DOCUMENTS

| | | |
|---|---|---|
| 1239890 | of 0000 | Fed. Rep. of Germany . |
| 2721168 | of 0000 | Fed. Rep. of Germany . |
| 1101565 | of 0000 | U.S.S.R. . |
| 1473413 | of 0000 | United Kingdom . |

*Primary Examiner*—Ira S. Lazarus
*Assistant Examiner*—L. Heyman

[57] ABSTRACT

A boiler plant, comprising at least a first boiler and a second boiler. The first boiler comprises a first superheater and a first reheater for generation and heating of steam. The second boiler comprises a second superheater and a second reheater for generation and heating of steam. A first high-pressure turbine is driven by steam generated by the first superheater and fed to the first high-pressure turbine. The steam is delivered to the first reheater after having been expanded in the first high-pressure turbine. A second high-pressure turbine is driven by steam generated by the second superheater and fed to the second high-pressure turbine. The steam is delivered to the second reheater after having been expanded in the second high-pressure turbine. An intermediate-pressure/low-pressure turbine is driven by reheated steam generated by the first and second reheaters fed to the intermediate-pressure/low-pressure turbine. At least one electric generator is operated by the first and the second high pressure turbines and the intermediate-pressure/low-pressure turbine.

6 Claims, 2 Drawing Sheets

STEAM SYSTEM IN A MULTIPLE BOILER PLANT

FIELD OF THE INVENTION

The invention relates to a plant concept for power plants comprising boiler modules with reheating of steam for turbines in a common steam system.

BACKGROUND OF THE INVENTION

In power plants where more than one boiler module is used to generat steam in separate steam generators for the respective boiler modules, steam from the respective steam generators may drive a steam turbine which is common to the boiler modules. If the steam generator in each boiler module comprises a high-pressure superheater and a reheater, the high-pressure steam from the different boiler modules is passed via valves to a common high-pressure turbine, where the steam expands and delivers energy, whereafter the steam is returned to the boiler modules for reheating in a reheater in the respective boiler module. The steam from the different reheaters is then passed to an intermediate-pressure and low-pressure turbine common to the modules, whereafter the steam, after condensing, is passed to a tank for feedwater, from which the water is utilized for new steam generation.

One reason for utilizing fewer turbines than the number of boiler modules is the considerable saving of costs for the installation of fewer steam turbine units in the plant.

In the normal operating range, that is, 30% to 100% of the power output from the plant, sliding pressure control is currently used. Sliding pressure control means that the pressure of the high-pressure steam, (live steam) and the pressure of the reheater steam are approximately proportional to the steam flow. During start-up and shutdown of the plant and in case of turbine trip (emergency stop of the turbine), the control of the boiler and the turbine, is performed in the most careful way. This means that the pressure in the reheater, determined by the pressure in the intermediate-pressure and low-pressure turbine, and hence the volume flow (the steam rate) through the high-pressure superheater and the flow volume through reheater in the load range, vary within acceptable limits without any special control.

If two boilers comprising reheaters are installed with a common steam turbine for both boilers, no problems arise for the high-pressure outlet of the steam turbine and for the reheaters of the boilers since the two boilers are driven with the same power. The individual boilers and the steam turbine have the same load expressed as a percentage. On the other hand, the distribution of the steam flows of the reheaters in the two boilers must be controlled in relation to each other with the aid of valves.

Control difficulties for a plant concept with two boilers and a common steam turbine arise when the two boilers are driven with different loads. The steam pressure before the intermediate-pressure turbine will then be the sum of the current reheater steam flows of the respective boilers divided by the design flow of the two reheaters. Before the high-pressure turbine the same conditions as with the intermediate-pressure turbine apply for the steam pressure. In other word, the sum of the steam flows in the two superheaters for high-pressure steam in the respective boilers divided by the design steam flows of these superheaters gives the pressure before the high-pressure turbine. If, for example, one boiler is driven with 50% load and the other boiler is driven with 100% load, the steam turbine will be driven with 75% of nominal full load. This means that the steam turbine receives an inlet steam pressure which amounts to 75% of the full load pressure. The superheater for live steam in the boiler which is driven with 100% load is designed so as to have, at this load, a volume flow and a steam rate which require full pressure in the superheater. Because of this, it is required that a higher pressure is applied to the superheater in this full-load boiler than what is justified by the inlet pressure at the steam turbine. In this connection, a throttle valve, for example, is utilized at the boiler outlet of the super-heater, whereby the pressure of this superheater is raised. A disadvantage of using a throttle valve is that an extra throttling loss is obtained.

On the other hand, the superheater in the boiler which is driven with only 50% load is subjected to a pressure which is 50% too high. This provides a considerably lower volume flow of steam through the superheater compared with the case where the boilers are working under equivalent conditions.

The steam pressure at the intermediate-pressure turbine, which is determined by the flow through the intermediate-pressure and low-pressure turbine, will also lie at 75% of the full-load pressure. The steam flow in the reheaters for the respective boiler must be distributed such that the reheater of each boiler is supplied with the correct steam flow in relation to the live steam flow out of the corresponding boiler. The steam pressure of the reheaters will be incorrect for both boilers in the same way as in the case of the above-described unbalance between the live steam pressures in the respective boilers. The pressure at the outlet of the high-pressure turbine, which is common to both boilers, must be maintained to avoid too high steam rates in the reheater belonging to the full-load boiler. As a result, the expansion line for the high-pressure turbine is reduced. Therefore, the output power from the plant is reduced compared with the output power which is achieved during parallel running of the two boilers with the same load, where the sum load for both boilers is the same as in the example described. Because of the reduced expansion, the temperature at the outlet from the high-pressure turbine is at the same time higher than the calculated temperature in the heat transfer area for the reheater. The temperature has to be reduced by, for example, water injection, which results in deteriorated efficiency. The boiler which is driven at only 50% of full load is, on the other hand, exposed to the opposite conditions. The reheater in this boiler senses too high a pressure which causes too low a volume flow whereas the temperature of the inlet steam is too low, which in turn contributes to the temperature of the outlet steam from the reheater becoming too low. These circumstances create demands for additional water injection into the reheater in this partial-load boiler, whereby a high pressure drop across the reheater is accomplished. Also, these circumstances contributes to a deterioration of the efficiency of the plant when the plant is not driven with equivalent loads in the two boilers. The lower temperature of the steam out of the reheater related to the steam turbine load may cause a problem for the steam turbine according to ruling standards.

SUMMARY OF THE INVENTION

The present invention comprises a number of boiler modules, an intermediate-pressure and low-pressure turbine common to these boiler modules, and a separate high-pressure turbine for each respective boiler module. The different high-pressure turbines are adapted in flow capacity to their boiler modules.

A generator which is driven by the different turbines may consist of a generator common to the turbines or of a generator for the intermediate- and low-pressure turbine with separate generators for each high-pressure turbine.

With an increase of the number of turbines according to the invention, the normal division between boiler and steam cycle is changed. In a boiler concept according to the invention, the gas cycle, the superheater for live steam, the high-pressure turbine and the reheater may be considered to be part of the boiler whereas the intermediate and low-pressure turbine constitutes the steam side.

An advantage of a boiler concept according to the invention is that the high-pressure turbines may be driven independently of each other and be adapted to the load with which the boiler to the respective connected high-pressure turbine is utilized. In this way, the above-mentioned throttling losses, which are unavoidable in the prior art, are avoided when different boiler modules must be driven under varying load conditions. The pressure in the reheaters will also be adapted to that which corresponds to the load of the respective boiler module.

If, for example, a boiler concept according to the above is utilized in a PFBC plant, it is possible to connect the high-pressure steam turbine and the gas turbine which is driven by the flue gases from the combustion in a PFBC combustor to a common shaft, with the steam turbine being either disconnectible or not disconnectible.

DESCRIPTION OF THE PREFERRED EMBODIMENT

An embodiment of the present invention will be described with reference to the accompanying drawings.

Figure 1:
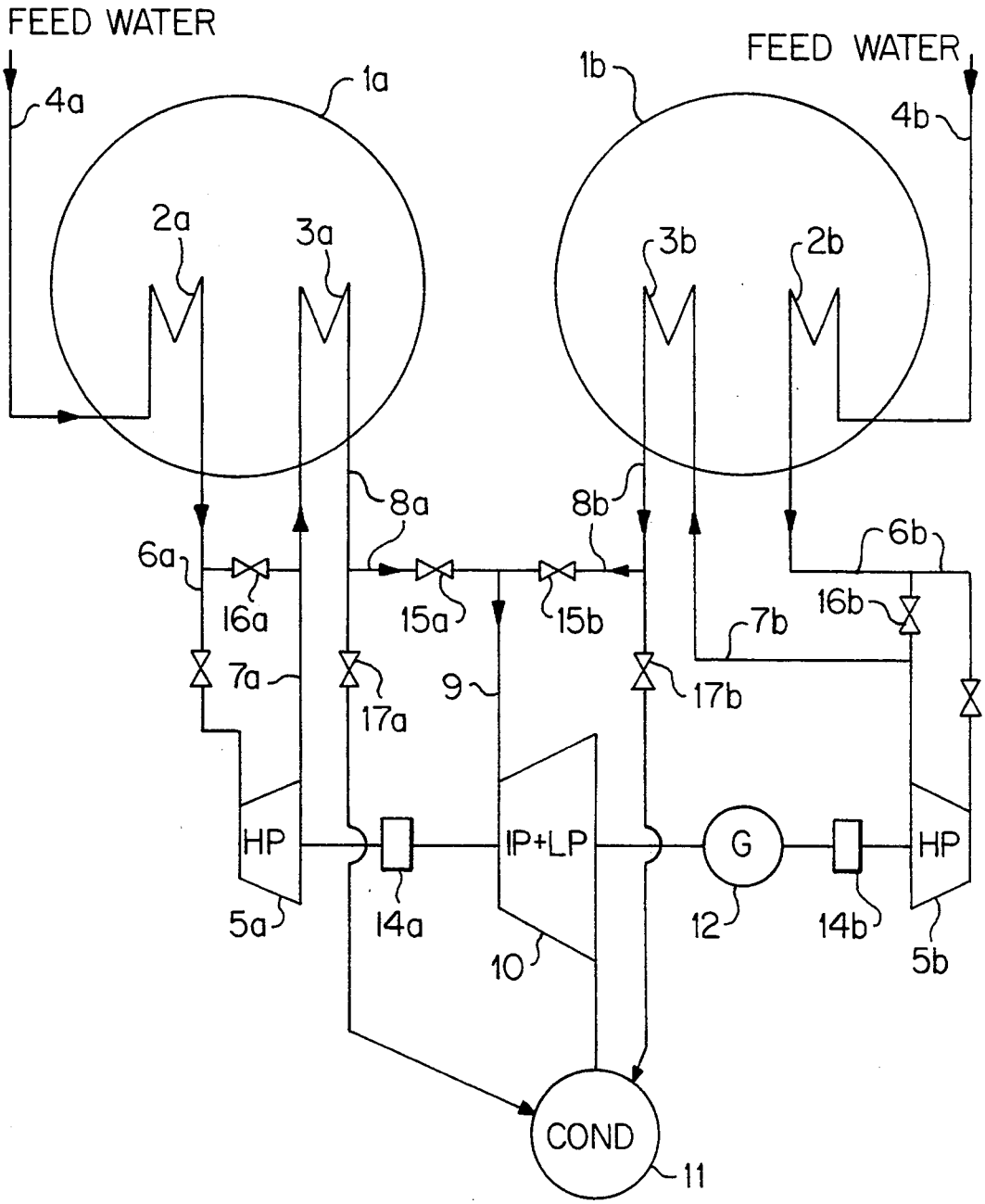
FIG. 1 schematically shows a boiler plant with two boiler modules and the associated steam turbines according to the invention.

FIG. 1 shows a boiler plant comprising two boiler modules 1*a*, 1*b*. These boiler modules may be heated in an optional way, the manner of heating being left out of consideration in this description. The first boiler module comprises a first superheater 2*a* for live steam and a reheater 3*a*. In a corresponding way, the second boiler module comprises a second superheater 2*b* for live steam and a second reheater 3*b*. Feedwater is brought via the conduits 4*a* and 4*b* to the respective superheaters 2*a*, 2*b*.

From the first superheater 2*a* for live steam in the first boiler module 1*a*, the steam is passed via a conduit 6*a* to a first high-pressure turbine 5*a* which is driven by the steam. In a corresponding way, steam from the second super-heater 2*b* for live steam is passed in the second boiler module 1*b* via a conduit 6*b* to a second high-pressure turbine 5*b*, which is driven by the steam from the second superheater 2*b*.

The steam expanded in the first high-pressure turbine 5*a* is returned to the reheater 3*a* of the first boiler module via a conduit 7*a* for reheating, whereafter the steam is passed out of the first boiler module via a conduit 8*a*. According to the same process, the steam expanded in the second high-pressure turbine 5*b* is returned to the reheater 3*b* of the second boiler module, whereafter the reheated steam is passed out of the second boiler module via a conduit 8*b*.

The reheated steam from the two reheaters 3*a*, 3*b* is brought together into a common steam conduit 9, which is connected to an intermediate- and low-pressure turbine 10 common to both boiler modules 1*a*, 1*b*. From this turbine 10 the low-tempered steam is fed to a condenser 11.

The two high-pressure turbines 5*a*, 5*b* and the common intermediate- and low-pressure turbine 10 may be mounted on a common shaft together with a generator 12, common to all three turbines 5*a*, 5*b*, 10, for generation of electric energy. In this case, the high-pressure turbines 5*a*, 5*b* are connected to the common intermediate- and low-pressure turbine 10 via couplings 14*a*, 14*b*.

In the steam conduits 8*a*, 8*b* for reheated steam there is a first reheater cut-off valve 15*a* for steam from the first boiler module 1*a* and a second reheater cut-off valve 15*b* for steam from the second boiler module 1*b*. Upon start-up, shutdown or trip of any of the boiler modules 1*a*, 1*b* in the plant, the desired boiler module can be separated from the rest of the plant by closing the first reheater cut-off valve 15*a* or, alternatively second reheater cut-off valve 15*b*. The necessary steam for the separated boiler module is then sluiced via a first high-pressure bypass valve 16*a* or a second high-pressure bypass valve 16*b*, belonging to the boiler module in question, through reheater 3*a* or 3*b* and is sluiced via a relevant first IP-, LP-bypass valve 17*a* or a second IP-, LP-bypass valve 17*b* to the condenser 11. Thus, the two boilers operate completely separately.

During partial-load operation of any of the boiler modules 1*a*, 1*b*, the high-pressure turbines 5*a*, 5*b* can be driven with the desired load quite independently of each other. By throttling either the first reheater cut-off valve 15*a* or the second reheater cut-off valve 15*b*, the pressure in the relevant reheater 3*a*, 3*b* can be maintained and hence allow running with different loads in the respective boiler modules 1*a*, 1*b*.

Figure 2:
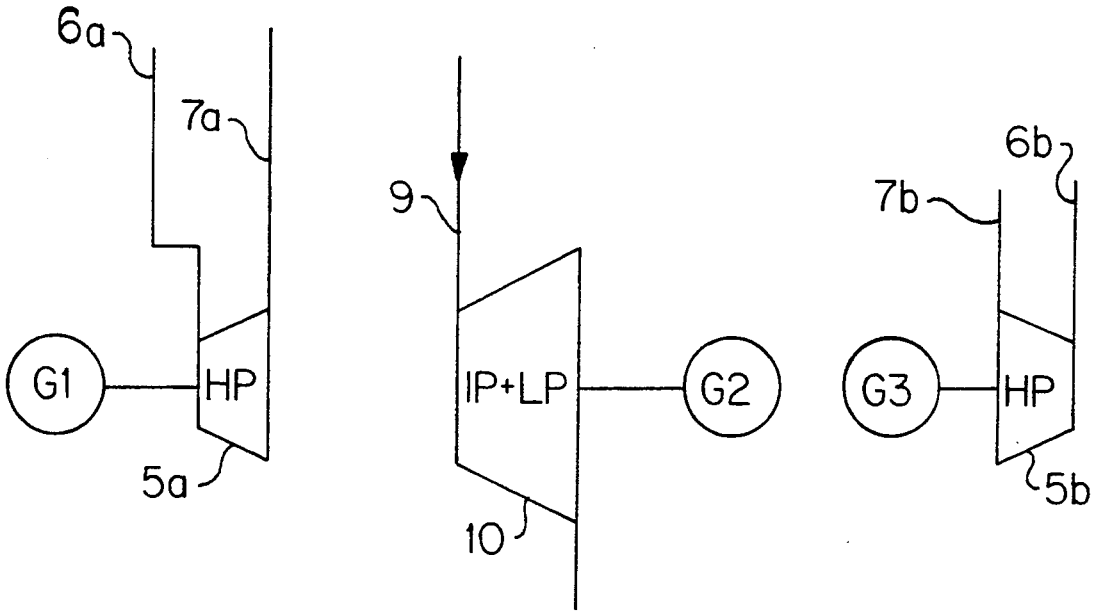
FIGS. 2 and 3 show variants of the connection between steam turbines and generators.
Figure 3:
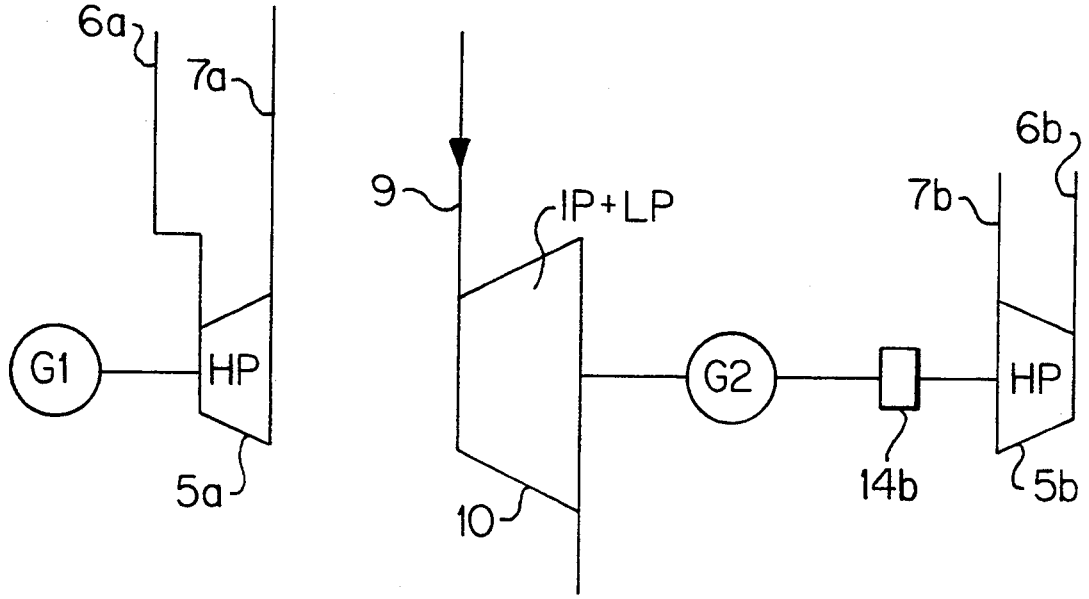

As is clear from the schematic FIGS. 2 and 3, there are alternative concepts for connecting generators to the different turbines. In FIG. 2 a variant is shown in which a generator G1, G2, G3 is connected to each individual turbine 5*a*, 5*b*, 10. Another alternative variant is illustrated in FIG. 3, in which a generator G1 is connected to one of the high-pressure turbines 5*a*, whereas another generator G2 is connected to the other high-pressure turbine 5*a* and the intermediate- and low-pressure turbine 10, the latter two turbines being mounted on a common shaft with an intermediate coupling 14*b*.

The plant concept described above only illustrates an example where two boiler modules utilize separate high-pressure turbines, whereas an intermediate- and low-pressure turbine is common to the two boiler modules. In a corresponding way, a plant can be arranged which comprises more than two boilers, in which each boiler drives separate high-pressure turbines, whereas the different boilers share a common intermediate- and low-pressure turbine.

We claim:

1. A boiler plant, comprising:

at least a first boiler and a second boiler, said first boiler including a first superheater and a first reheater for generation and heating of steam, said second boiler including a second superheater and a second reheater for generation and heating of steam;

a first high-pressure turbine driven by steam generated by said first superheater and fed to said first high-pressure turbine, the steam being delivered to the first reheater after having been expanded in said first high-pressure turbine;

a second high-pressure turbine driven by steam generated by said second superheater and fed to said second high-pressure turbine, the steam being delivered to the second reheater after having been expanded in said second high-pressure turbine;

an intermediate-pressure/low-pressure turbine driven by reheated steam generated by the first and second reheaters fed to said intermediate-pressure/-low-pressure turbine; and at least one electric generator operated by the first and the second high pressure turbines and the intermediate-pressure/low-pressure turbine.

2. A boiler plant according to claim 1, further comprising:

a first shaft on which said first high pressure turbine is arranged;

a second shaft on which said second high pressure turbine is arranged;

a third shaft on which said intermediate-pressure/-low-pressure turbine is arranged;

said first, said second and said third shaft being axially aligned;

a first coupling connecting the first shaft to the third shaft; and a second coupling connecting the second shaft to the third shaft.

3. A boiler plant according to claim 1, wherein at least one of the first and second high-pressure turbines is arranged on and drives a generator on a separate shaft.

4. A boiler plant according to claim 2, further comprising:

a first control valve arranged between said first reheater and said intermediate-pressure/low-pressure turbine and a second control valve arranged between said second reheater and said intermediate-pressure/low-pressure turbine, such that by operating said first or second control valve said first boiler and said first high-pressure turbine can be driven at a partial load independently of the degree of load of said second boiler and said second high-pressure turbine.

5. A boiler plant according to claim 3, further comprising:

a first control valve arranged between said first reheater and said intermediate-pressure/low-pressure turbine and a second control valve arranged between said second reheater and said intermediate-pressure/low-pressure turbine, such that by operating said first or second control valve said first boiler and said first high-pressure turbine can be driven at a partial load independently of the degree of load of said second boiler and said second high-pressure turbine.

6. A boiler plant, comprising:

a plurality of boilers, each of said boilers including a superheater and a reheater for steam generation and heating;

a plurality of high-pressure turbines each driven by steam generated by a respective superheater and fed to a respective high-pressure turbine, the steam being delivered to a respective reheater after having been expanded in a respective high-pressure turbine;

at least one intermediate-pressure/low-pressure turbine driven by reheated steam generated by said reheaters and commonly fed to said at least one intermediate-pressure/low-pressure turbine; and at least one electric generator operated by said high pressure turbines and the at least one intermediate-pressure/low-pressure turbine.

* * * * *